United States Patent [19]

Kellner

[11] 4,036,465

[45] July 19, 1977

[54] ADJUSTABLE STAND

[76] Inventor: Sam J. Kellner, 315 E. 69th St., New York, N.Y. 10021

[21] Appl. No.: 656,174

[22] Filed: Feb. 9, 1976

[51] Int. Cl.[2] ..... A47B 97/04

[52] U.S. Cl. ..... 248/463

[58] Field of Search ..... 248/413, 441 R, 448, 248/449, 451, 455, 456, 460, 461, 463, 464, 465

[56] References Cited

U.S. PATENT DOCUMENTS

| | | | |
|---|---|---|---|
| 392,565 | 11/1888 | Larew | 248/464 |
| 1,182,621 | 5/1916 | Bain | 248/413 |
| 1,309,375 | 7/1919 | Taylor | 248/413 |
| 1,790,487 | 1/1931 | Ruhnau | 248/451 X |
| 2,973,933 | 3/1961 | Howell | 248/460 X |
| 3,330,524 | 7/1967 | Foley | 248/441 R |

FOREIGN PATENT DOCUMENTS

| | | | |
|---|---|---|---|
| 10,885 | 2/1880 | Germany | 248/465 |
| 8,172 | 4/1909 | United Kingdom | 248/463 |

*Primary Examiner*—William H. Schultz
*Attorney, Agent, or Firm*—Bernard Ouziel

[57] ABSTRACT

A portable stand constructed from four tubular telescoping legs forming a pair of A-frames separated by tubular telescoping cross members to which are fastened a hinged table for supporting books, periodicals and other documents. By adjusting set screws, both the height and width of the stand can be adjusted to facilitate hands-free use of the stand by persons reading in bed, a chair, a lounge, a sofa, or even while standing.

6 Claims, 4 Drawing Figures

ADJUSTABLE STAND

BACKGROUND AND SUMMARY OF THE INVENTION

My invention relates generally to a new and unique portable book, newspaper or periodical stand that may readily be adjusted to facilitate hands-free reading in a variety of situations.

There is currently available a number of adjustable stands which may be used for holding books, sheet music, maps and other documents to facilitate reading by people who cannot or wish not to hold such materials themselves. But, while prior are stands permit adjustment of the angle of the book support and even the height of the entire structure, they are generally more cumbersome and less versatile than the structure I have invented.

Accordingly, it is an object of my invention to provide a collapsible and portable adjustable book stand.

It is another object of my invention to provide such a stand of inexpensive light-weight construction.

It is still another object of my invention to provide a book holding stand adjustable in both height and width to accommodate a great variety of hands-free reading positions.

My invention is a portable stand constructed from tubular telescoping legs forming a pair of A-frames which are separated and braced by tubular telescoping cross members to which are fastened a hinged table for supporting books, newspapers, periodicals and other documents. Each telescoping leg and cross member is constructed with an outer jacket into which is fitted a sliding runner.

A back plate is affixed to two of the cross members in a manner which does not impede their ability to telescope. A bottom plate is fastened to the back plate by means of a hinge which permits a 90° (or such other convenient angle of) rotation there between. The bottom plate contains an adjustable movable page holder to accommodate books or periodicals of varying thickness and widths.

Each A-frame is constructed by fastening the ends of each of two legs in a pivot joint and controlling the angle to which the legs may be opened by fastening a locking collapsible brace at a point intermediate the length of each of the two legs.

The height of each leg may be varied by adjusting a set screw which permits the extension of a telescoping member up to the desired length. Similarly, set screws in crossbracing members permit the stand to be adjusted in width in order to facilitate hands-free use of the stand by persons reading while in a bed, a chair, a lounge, a sofa and even while standing. Because the stand may be adjusted in both height and width, it may, for example, be placed with legs straddling the reader resting on a bed or with legs resting on the floor to the side or front of a reader.

DESCRIPTION OF THE INVENTION

Figure 1:
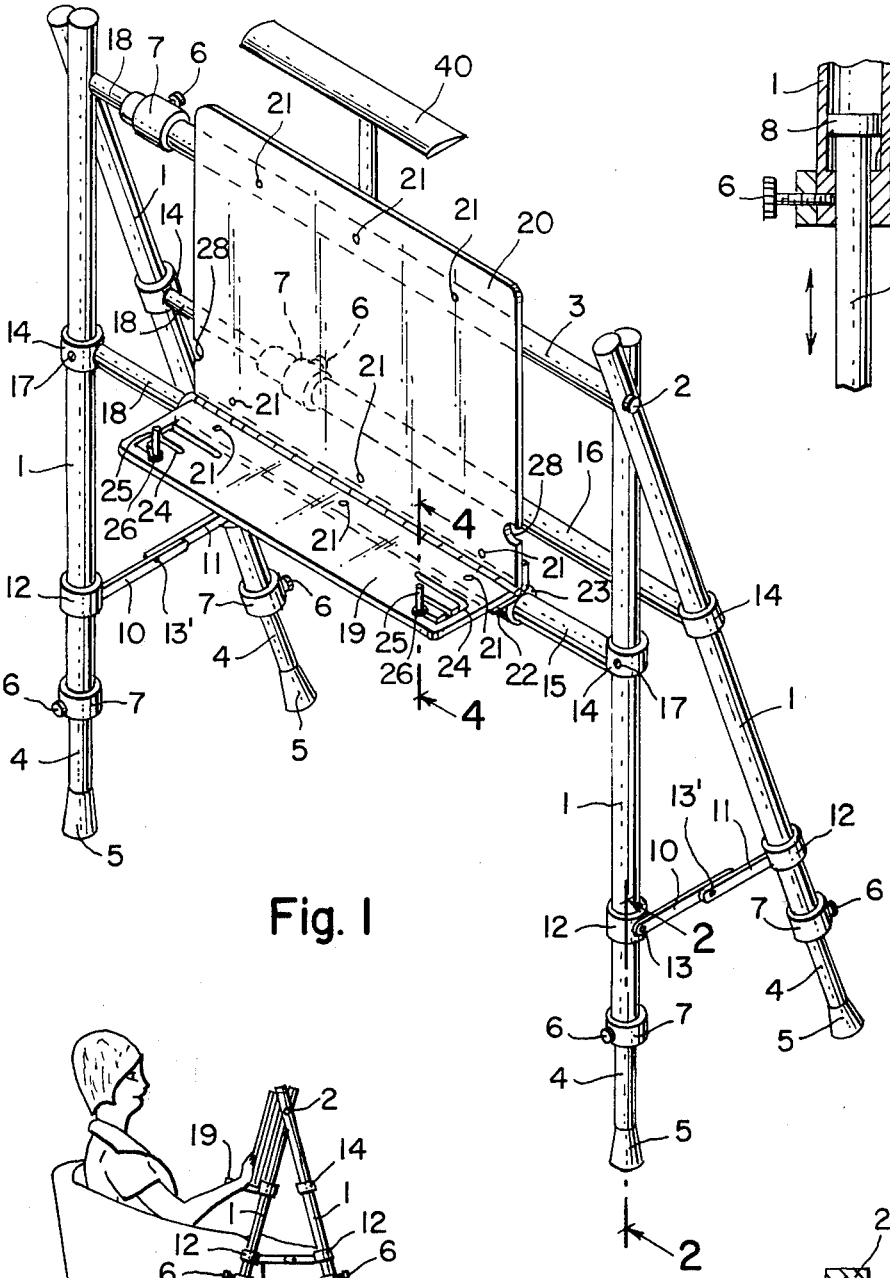
Figure 2:
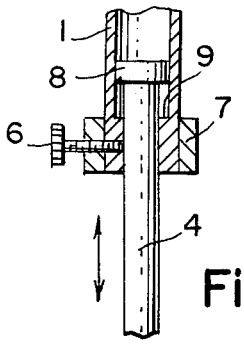
Figure 3:
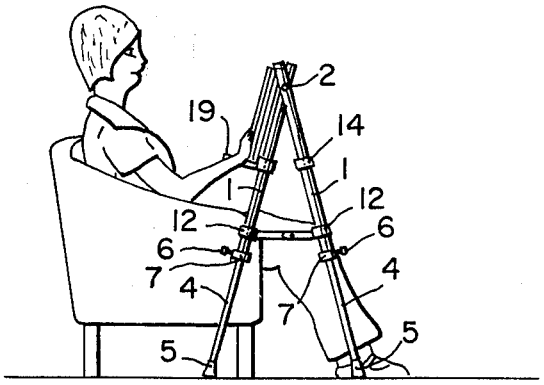
Figure 4:
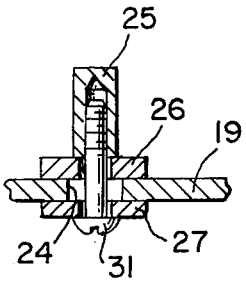

The above and other objects and features of my invention will be better understood by reference to the following detailed description and accompanying drawing in which:

FIG. 1 is a perspective view of a preferred embodiment of a book-holding stand in accordance with this invention;

FIG. 2 is a cross-section taken in a plane passing through lines 2—2 of FIG. 1; and FIG. 3 is a side elevation of the FIG. 1 stand supporting a book, adjusted and positioned for use by a person sitting on a chair; and FIG. 4 is a cross-section of a holding-pin taken in a plane passing through lines 4—4 of FIG. 1. Referring now to FIG. 1, there is shown in detail the construction of the adjustable stand constructed in accordance with the invention. On each side there is a pair of legs 1 fastened at one end in a pivot 2 made from a bolt passing through legs 1 and threaded into each end of top cross member 3. Legs 1 are tubular in construction with an inside diameter larger than the outside diameter of extension members 4 telescoping therefrom and terminating in skid-proof feet 5.

The length of each leg may be adjusted by loosening set screw 6 in collar 7 fitted around the free end of leg 1. Set screw 6 is threaded through a hole in collar 7 and tightened to rest against the surface of extension member 4 after it is adjusted to the proper length. Shoulder 9 is provided at the free end of legs 1 to provide a stop for head 8 of extension member 4 when the latter is fully telescoped out of leg 1.

Legs 1 open to a convenient angle fixed by a locking collapsible brace formed from links 10 and 11 each joined at opposite ends to legs 1 by pivot fastener 3 through collar 12 secured to legs 1. Adjacent ends of links 10 and 11 are joined also in a pivot fastener 13. As will be familiar to those versed in the art, links 10 and 11 have a nipple and depression which, when engaged, stably separate legs 1 in an A-frame construction. Separating the two A-frames are top cross-member 3, front lower cross member 15 and, if desired, rear lower cross member 16.

Front and rear lower cross members 15 and 16 are fastened to collars 14 by threading one into the other or by such other means as are known to those versed in the art. Additionally, by means of a set screw 17, collars 14 may be secured in place on legs 1.

Front and rear cross members 15 and 16 are constructed in a fashion similar to the leg members in that each is provided with a collar 7 at a free end through which is threaded set screw 6 to bear upon an extension member 18 having an outside diameter sufficiently small to telescope from the inside diameter of members 15 and 16. As with legs 1, extension members 18 are provided with a head that stops on an inside shoulder of cross members 15 and 16 to provide a stop in the telescoping extensions 18.

As described in connection with legs 1, extensions members 18 may be moved relative to cross members 15 and 16 to separate the two A-frames to that distance which a reader finds comfortable for a particular situation. Thus, for example, the separation may be relatively narrow when the stand is placed on a mattress across the body of one lying in bed; it will be wider when used as shown in FIG. 3 by a reader sitting in a chair, or a sofa; and still wider if used to straddle or to the side of a lounge or hospital bed.

The reading material is supported by a table formed from plates 19 and 20 joined by rivets 21 to hinge 22 to open at right angles to each other. Hinge 22 is, in turn, fastened along its length to sleeve 23 which is fitted about and fastened to lower cross front member 15. Additionally, back plate 20 is fastened by rivets or in some other suitable manner to back cross member 3.

Each end of bottom plate 19 is provided with a series of channels 24 running parallel to hinge 22 and interconnected by a mutually perpendicular access channel. The parallel channels may be cut to decreasing length as they become further removed from hinge 22. Located at each end of bottom plate 19 is a holding-pin 25 which, as shown in FIG. 4, is constrained to move within its associated group of channels. Each holding-pin 25 is fastened in place by a screw 31 and a pair of washers 26 and 27 between which bottom plate 19 is sandwiched. The head of screw 31 bears upon bottom washer 27, while the threaded portion is fastened within a tapped hole of holding-pin 25 separated from bottom plate 19 by top washer 26. In this fashion, each holding-pin 25 may be secured in place by tightening it against screw 31 after being located at a position within the channels to accommodate books of varying thicknesses and widths.

To facilitate the portability of the stand, it may be folded into a very compact structure by raising lower plate 19 until it is contiguous to back plate 20, with holding pins 25 being positioned within the channels so that they protrude through hole 28 in back plate 20. Additionally, telescoping extensions 4 are inserted within legs 1 and extension braces 18 are telescoped into cross braces 15 and 16.

The legs and cross members may be made from tubular light-weight plastic, aluminum or other structural materials as are familiar to those versed in the art. Similarly, back plate 20 and lower plate 19 may also be fabricated of some plastic or metal suitable for the purpose. Also, if desired, a reading lamp 40 may be secured to either back plate 20 or cross member 3 to serve the convenience of those desiring it.

It is to be understood that the above-described arrangements are illustrative of the application of the principles of the invention. Numerous other arrangements may be devised by those skilled in the art without departing from the spirit and scope of the invention.

I claim:

1. An adjustable, portable stand including a first and a second pair of legs each comprising a jacket and a runner telescoping from within said jacket, each pair of leg jackets being fastened together at one end to permit angular motion therebetween and having means for stably effecting an angular separation therebetween; means for fixedly adjusting the telescoped length of each runner; a pair of cross bracing members each comprising a jacket and runner telescoping from within said jacket and disposed between said first and second pair of legs having a means for fixedly adjusting the length of each cross member; and a table having back plate fixed to said cross member jackets and a bottom plate joined to said back plate by a hinge permitting fixed angular movement therebetween.

2. An adjustable portable stand in accordance with claim 1 wherein each end of said bottom plate has a holding means comprising a series of place channels parallel to said hinge, an access channel in each end of said bottom plate interconnecting said place channels and a holding pin at each end of said bottom plate constrained for movement within said place and access channels.

3. An adjustable portable stand in accordance with claim 2 wherein a first washer is placed between said holding pin and the upper face of said bottom plate over a channel, a second washer is placed on the lower face of said bottom plate opposite said first washer, and wherein a screw having a head bearing upon said second washer and a shank passing through said washers is threaded into a hole tapped axially in said holding pin to permit said holding pin to be adjustably tightened in place.

4. An adjustable, portable stand in accordance with claim 2 wherein a third telescoping cross bracing member comprising a jacket and a runner telescoping from within said jacket is disposed between said first and second pair of legs.

5. An adjustable, portable stand in accordance with claim 4 wherein said means for fixedly adjusting the length of each of said runners telescoping from each of said leg jackets and each of said cross bracing jackets includes a collar affixed to an end of each jacket from which the said telescoping runner emerges and a set screw threaded through said collar and jacket to bear upon the telescoping runner.

6. An adjustable portable stand in accordance with claim 5 wherein each runner is fitted with feet and wherein said back plate has an aperture dimensioned to accept and disposed opposite a selected position for each of said holding pins when said bottom plate is folded against said back plate.

* * * * *